United States Patent [19]

Sugimoto et al.

[11] 4,267,265

[45] May 12, 1981

[54] PHOTOGRAPHIC LIGHT-SENSITIVE MATERIAL

[75] Inventors: Naohiko Sugimoto; Ikutaro Horie; Kameji Nagao; Masakazu Yoneyama, all of Minami-ashigara; Yasuhiro Nakayama, Fujimiya; Nobuo Yamamoto, Minami-ashigara, all of Japan

[73] Assignee: Fuji Photo Film Co., Ltd., Minami-ashigara, Japan

[21] Appl. No.: 974,460

[22] Filed: Dec. 29, 1978

Related U.S. Application Data

[63] Continuation of Ser. No. 711,920, Aug. 5, 1976, abandoned, which is a continuation of Ser. No. 549,259, Feb. 12, 1975, abandoned.

[30] Foreign Application Priority Data

Feb. 13, 1974 [JP] Japan ..... 49-17393

[51] Int. Cl.[3] ..... G03C 1/31

[52] U.S. Cl. ..... 430/523; 430/527; 430/539; 430/961; 430/631; 430/633; 430/635

[58] Field of Search ..... 96/87 R, 87 A, 114.5, 96/114.4, 114.2; 430/527, 529, 954, 961, 523, 539, 631, 633, 635

[56] References Cited

U.S. PATENT DOCUMENTS

| | | | |
|---|---|---|---|
| 3,754,924 | 8/1973 | De Geest | 96/114.5 X |
| 3,850,642 | 11/1974 | Bailey et al. | 96/87 A |
| 3,862,860 | 1/1975 | Pardee et al. | 96/87 RX |
| 3,884,699 | 5/1975 | Cavallo et al. | 96/87 A |
| 4,201,586 | 5/1980 | Hori et al. | 430/631 X |

*Primary Examiner*—John D. Welsh

*Attorney, Agent, or Firm*—Sughrue, Rothwell, Mion, Zinn and Macpeak

[57] ABSTRACT

A silver halide photographic light-sensitive material comprising a support having thereon at least one light-sensitive silver halide emulsion layer and a surface layer thereof containing an organic fluoro-compound and a carboxy group-containing compound, resulting in an improvement in the physical characteristics of the surface.

13 Claims, No Drawings

PHOTOGRAPHIC LIGHT-SENSITIVE MATERIAL

This application is a Continuation Application of Ser. No. 711,920, filed Aug. 5, 1976, in turn a continuation application of Ser. No. 549,259, filed Feb. 12, 1975, now abandoned.

BACKGROUND OF THE INVENTION

1. Field of the Invention

The present invention relates to a silver halide photographic material whose surface layer physical characteristics are particularly improved.

2. Description of the Prior Art

A commonly used silver halide photographic material has a surface layer or an outermost layer containing a hydrophilic colloid such as gelatin as a binder. Therefore, the adhesiveness or tackiness of the surface of such a photographic material increases in an atmosphere of high humidity, especially under the circumstances of high temperature and humidity, to result in adhesion easily to another body with which the photographic material comes into contact. Various disadvantages are often caused by this adhesion phenomena which takes place between different parts of a photographic material or between a photographic material and another material when they are allowed to stand in contact with each other in the course of manufacturing a photographic material, taking a photograph, processing a photographic material, projecting a photographic material or storing a photographic material. A remarkable tendency of such adhesion phenomenon appears especially when the surface layer and/or the adjacent layers thereto of a photographic material contains hygroscopic or tacky compounds.

As a method for solving this problem, the so-called matt layer-making method is well known, wherein the presence of a fine powder of an inorganic compound such as silicon dioxide, magnesium oxide, titanium dioxide, calcium carbonate, etc., or the presence of a fine powder of an organic compound such as polymethylmethacrylate, cellulose acetate propionate, etc., in the surface layer causes the coarseness of the surface to increase to result in a decrease in adhesiveness of the surface. This matt layer-making method is accompanied by some undesirable side effects as described below. Namely, (i) a homogeneously coated-layer can not be obtained because the above-mentioned fine powders easily aggregate in the coating solution, (ii) the photographic material containing the above-mentioned fine powders in a surface layer is tends to be damaged and is harder to drive in a camera or a projector than if the above-mentioned fine powders were not present because of the decrease in the slipping ability of the surface, (iii) the transparency of the photographic material after processing is reduced due to the presence of the above-mentioned fine powders in a surface layer, (iv) the granularity of the image is degraded by the presence of the above-mentioned fine powders in a surface layer, and the like.

As another means of improving the adhesive resistance of a photographic material without the above-mentioned adverse side effects, it was confirmed that the addition of an organic fluoro-compound into the surface layer of a photographic light-sensitive material was extremely effective.

However, a photographic light-sensitive material containing in a surface layer an organic fluoro-compound turned out to be disadvantageous from the standpoint of static characteristics. That is to say, a photographic light-sensitive material containing an organic fluoro-compound has a tendency to be greatly negatively charged when allowed to be come into contact with or rubbed with a metallic roller, fluorecence sensitized paper, interposed paper and so on, and dendroid stains, the so-called static marks, appear on a photographic light-sensitive material upon discharging. Therefore, an improvement in the above-mentioned static characteristics is needed.

SUMMARY OF THE INVENTION

An object of the present invention is to provide photographic materials having excellent adhesion resistance combined with excellent antistatic properties.

Another object of the present invention is to provide photographic light-sensitive materials which demonstrate both improved adhesion resistance and antistatic properties without the above-mentioned adverse side effects.

A further object of the present invention is to provide photographic light-sensitive materials which contain hygroscopic or tacky compounds and which demonstrate both good adhesion resistance and antistatic properties.

Still another object of the present invention is to provide a method for improving the adhesion resistance and antistatic properties of photographic light-sensitive materials.

Another object of the present invention is to provide a method for improving the adhesion resistance and antistatic properties of photographic light-sensitive materials which contain hygroscopic or tacky compounds.

These and other objects of the present invention will be apparent from the following detailed descriptions.

The above-described objects are attained with both an organic fluoro-compound and a carboxy group-containing compound in a surface layer of a photographic light-sensitive material.

Accordingly this invention provides a photographic light-sensitive material having excellent anti-adhesive and anti-static properties comprising a support having thereon at least one light-sensitive emulsion layer and a surface layer containing an organic fluoro-compound and a carboxy group-containing compound.

This invention further provides a method for improving the adhesion resistance and anti-static properties of a photographic light-sensitive material which comprises impregnating a protecting layer and/or an emulsion layer of the light-sensitive material containing an organic fluoro-compound having in the same molecule at least three fluorine atoms and a group in which at least three carbon atoms combine to form carbon-carbon bonds, with an aqueous solution containing at least one carboxy group-containing compound.

DETAILED DESCRIPTION OF THE INVENTION

The organic fluoro-compounds which can be employed in the present invention possess not less than three fluorine atoms in one molecule, and a group wherein at least three carbon atoms combine to form carbon-carbon bonds, e.g., a perfluoroheptyl group, a perfluorooctyl group, a 10-hydroxyeicosylfluorodecyl group, etc.

Of the above compounds, compounds having aliphatic hydrocarbon groups, especially alkyl groups, the hydrogen atoms of which are partially or fully replaced with fluorine atoms, are useful.

In addition, groups which render the above fluorine-substituted compounds moderately hydrophilic should be introduced into the above organic fluoro-compounds in order to facilitate the addition of these compounds to a hydrophilic surface layer. Useful groups that render the above organic fluoro-compounds hydrophilic are a carboxylic acid group, a sulfonic acid group, a sulfuric acid group, a phosphoric acid group, salts of each of these acid groups such as the sodium salt, the potassium salt, the ammonium salt, etc., a hydroxy group, an oxyalkylene group, an onium group such as a quaternary ammonium group, a diester group and the like. Anionic compounds having a group selected from the group consisting of a carboxylic acid, a sulfonic acid, a sulfuric acid, a phosphoric acid and the salts of each of these acid groups are particularly preferred for employment herein.

Of course, the organic fluoro-compounds can be employed individually or as mixtures.

Organic fluoro-compounds which are preferably employed in the present invention are represented by the following general formulae:

(1) $W_1$—$Y_1$ wherein $W_1$ represents

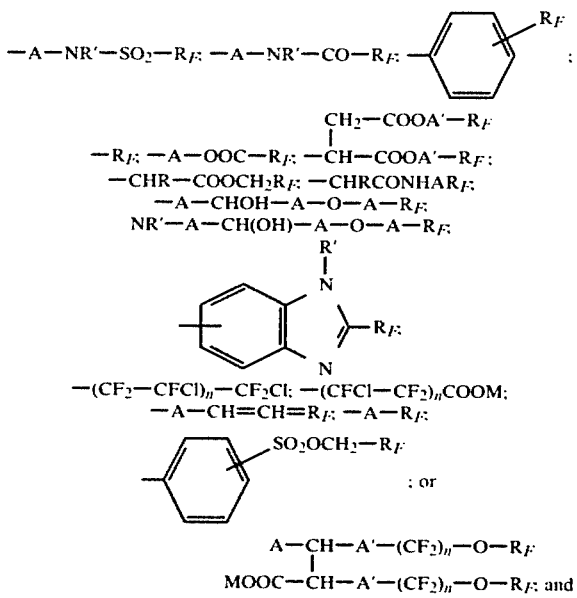

$Y_1$ represents

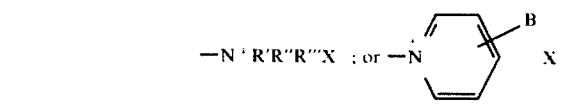

(2) $W_2$—$Y_2$ wherein $W_2$ represents

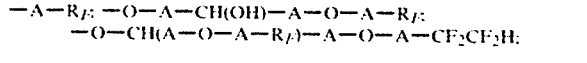

-continued

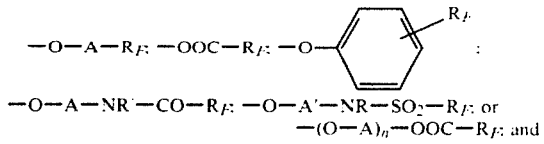

$Y_2$ represents $—(CH_2CH_2O)_nH$ or $—(CH_2CH_2O)_nR'$ (3) $W_3$—$Y_3$ wherein $W_3$ represents

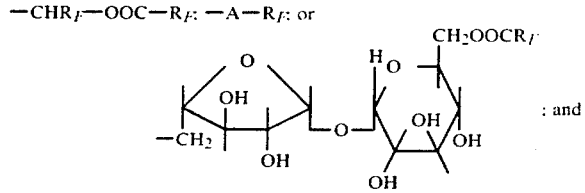

$Y_3$ represents —OH or —OOCR'

(4) $W_4$—$Y_4$ wherein $W_4$ represents

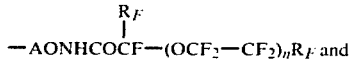

$Y_4$ represents

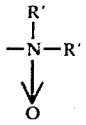

(5) $W_5^+$—$COO^-$ wherein $W_5^+$ represents

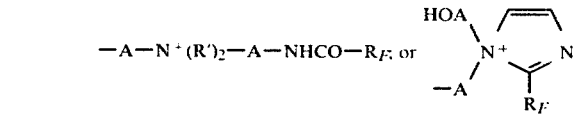

In the above general formulae (1) to (5), R represents an alkyl group (both unsubstituted and substituted) having 1 to 32 carbon atoms (e.g., an ethyl group, an octyl group, etc.), R' represents a hydrogen atom or an alkyl group (both unsubstituted and substituted, having 1 to 32 carbon atoms (e.g., a propyl group), A and A' each represents a divalent aliphatic hydrocarbon group, preferably a methylene group, an ethylene group, a propylene group, an ethylidene group, etc., M represents a hydrogen atom or an alkali metal atom or an ammonium group dissociating into an ion in an aqueous solution, such as sodium, potassium, $NH_4$, etc., B represents a hydroxy group, an alkoxy group having 1 to 4 carbon atoms (e.g., a methoxy group, an ethoxy group, etc.), a carboxy group, an alkoxycarbonyl group (e.g., having 2 to 6 carbon atoms) or an alkyl group (e.g., both unsubstituted and substituted and having 1 to 6 carbon atoms), R'' represents a lower alkyl group (both unsubstituted and substituted) having 1 to 4 carbon atoms (e.g., an ethyl group, a butyl group, etc.), $R_F$ represents a perfluoroalkyl group having 1 to 22 carbon atoms (e.g., preferably a perfluorooctyl group), $X^-$ represents an anion such as a bromide ion, a perchlorate ion, a sulfate ion, etc., and n represents 0 or an integer ranging from 1 to 20.

Specific examples of organic fluoro-compounds represented by the general formulae (1) to (5) are described below $CF_3(CF_2)_6-COONH_4$ (1-1)

$CF_3(CF_2)_9-(CH_2)_{10}-COOH$ (1-2)

$CF_3(CF_2)_5-(CH_2)_{10}-COONa$ (1-3)

$ClCF_2-(CF(Cl)-CF_2)_4-COOH$ (1-4)

$H(CF_2CF_2)_5-COONa$ (1-5)

$HOOC-(CF_2-CF(Cl))_4-COOH$ (1-6)

$Cl(CF_2-CF(Cl))_3-CF_2-COOK$ (1-7)

$CF_3-(CF_2)_6-CH=CH-(CH_2)_3-COONa$ (1-8)

$CF_3-(CF_2)_3-CF(CF_3)-(CH_2)_{10}-COONa$ (1-9)

$H(CF_2CF_2)_4-CH_2OSO_2-C_6H_4-COOH$ (1-10)

$CF_3(CF_2)_7-CO-N(CH_3)-(CH_2)_2-COONa$ (1-11)

$Cl(CF_2CF_2)_3-COONa$ (1-12)

$CF_3(CF_2)_3-CH_2CH_2-SO_2-N(C_2H_5)-CH_2-COONa$ (1-13)

$CF_3(CF_2)_7-SO_2-N(C_2H_5)-CH_2-COONa$ (1-14)

$CF_3(CF_2)_7-SO_2-N(C_2H_5)-(CH_2)_6-COOK$ (1-15)

$CF_3(CF_2)_7-SO_2-N(C_3H_7)-CH_2-COOK$ (1-16)

$CF_3(CF_2)_7-SO_2-N(C_3H_7)-(CH_2)_3-COOK$ (1-17)

$CF_3(CF_2)_7-SO_2-N(C_2H_5)-CH_2-SO_3H$ (1-18)

$CF_3(CF_2)_6-CO-N(C_2H_5)-(CH_2)_2-SO_3K$ (1-19)

$CF_3(CF_2)_2-C_6H_4-SO_3K$ (1-20)

(the $-SO_3K$ group can be situated at the o-, m- or p-position)

$CF_3(CF_2)_3-C_6H_4-SO_3Na$ (1-21)

(the $-SO_3Na$ group can be situated at the o-, m- or p-position)

$CF_3(CF_2)_7-SO_3K$ (1-22)

$CF_3(CF_2)_{11}-CH_2-OSO_3Na$ (1-23)

$CF_3(CF_2)_6-COO-(CH_2)_3-SO_3Na$ (1-24)

$H(CF_2)_6-CH_2-O-(CH_2)_3-SO_3Na$ (1-25)

$NaO_3S-CH(CH_2-COOCH_2-(CF_2)_6-H)-COOCH_2-(CF_2)_6-H$ (1-26)

$C_{16}H_{33}-CH(SO_3Na)-COOCH_2-CF_3$ (1-27)

-continued $C_{16}H_{33}-CH(SO_3Na)-CONHCH_2-CH_2-CF_2H$ (1-28)

$CF_3-(CF_2)_7-SO_2-N(CH_3)-CH_2CH_2OSO_3H$ (1-29)

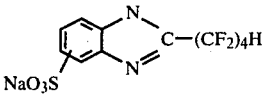
(1-30)

(the $-SO_3Na$ group can be situated at the 4- or 5-position)

$C_8F_{17}SO_2N(C_2H_5)CH_2CH_2PO(OH)_2$ (1-31)

$C_8F_{17}SO_2N(C_3H_7)CH_2CH=PO(OH)_2$ (1-32)

$CF_3-(CF_2)_{12}-COO-(CH_2CH_2O)_{20}H$ (1-33)

$CF_3-(CF_2)_6-CO-N(CH_3)-(CH_2)_2-O-(CH_2CH_2O)_4H$ (1-34)

$CF_3(CF_2)_7-SO_2-N(C_2H_5)-(CH_2)_2-O-(CH_2CH_2O)_{20}H$ (1-35)

$CF_3-(CF_2)_8-COO-(CH_2CH_2O)_8-CH_3$ (1-36)

$H-(CF_2CF_2)_8-CH_2OH$ (1-37)

$H-(CF_2CF_2)_3-CH_2OH$ (1-38)

$CF_3-(CF_2)_6-COO(CH_2-CH(CH_3)-O)_4-(CH_2CH_2O)_{20}H$ (1-39)

$CF_3(CF_2)_6-COO-(CH_2-CH(CH_3)-O)_3-(CH_2CH_2O)_{10}-(CH_2)_4-CH_3$ (1-40)

$CF_3-(CF_2)_7-SO_2NH(CH_2)_3-N^+(CH_3)_3 \cdot I^-$ (1-41)

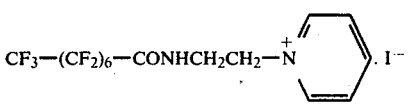
(1-42)

$CF_3-(CF_2)_6-CONH(CH_2)_3-N^+(CH_3)_2-CH_2-CH_2-COO^-$ (1-43)

$CF_3-(CF_2)_7-SO_2NHCH_2CH_2-N^+(CH_2CH_3)_2-CH_2-COO^-$ (1-44)

$CF_3-C(C_2H_5)(C_2F_5)-C(CF_3)(CH_2O(CH_2CH_2O)_7H)-CHF-CF_3$ (1-45)

$CF_3-C(C_2F_5)(C_2F_5)-C(CF_3)(COO(CH_2CH_2O)_4H)-CHF-CF_3$ (1-46)

$CF_3-C(C_2F_5)(C_2F_5)-C(CF_3)(COONa)-CHF-CF_3$ (1-47)

$CF_3-C(C_2F_5)(C_2F_5)-CH(CF_3)-CF(CF_3)-COONa$ (1-48)

$CF_3-C(C_2F_5)(C_2F_5)-CH(CF_3)-CF(CF_3)-CONH(CH_2)_3N^+(CH_3)_3 \cdot Cl^-$ (1-49)

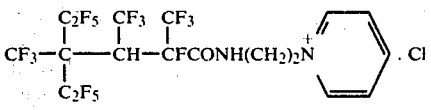
(1-50)

-continued (1-51)

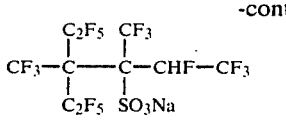

(1-52)

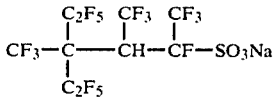

(1-53)

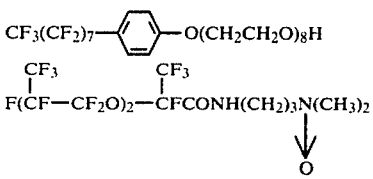

(1-54)

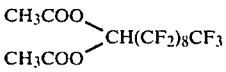

(1-55)

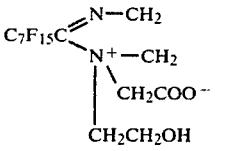

(1-56)

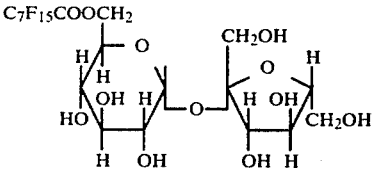

(1-57)

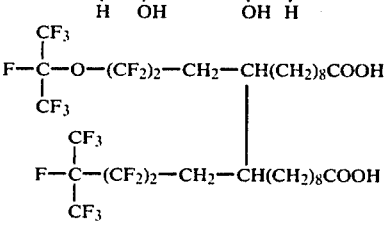

(1-58)

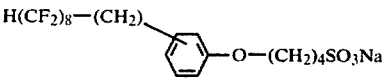

(1-59)

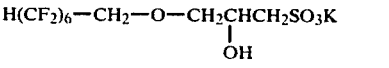

(1-60)

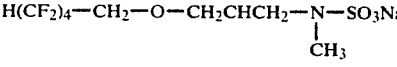

(1-61)

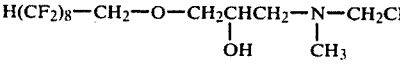

(1-62)

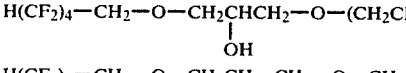

(1-63)

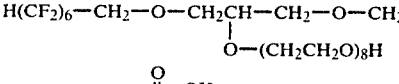

(1-64)

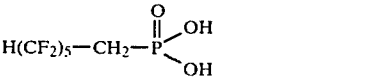

(1-65)

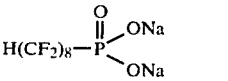

(1-66)

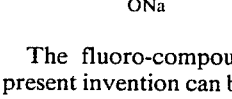

The fluoro-compounds which can be used in the present invention can be synthesized according to methods as disclosed in, for example, U.S. Pat. Nos. 2,559,751; 2,567,011; 2,732,398; 2,764,602; 2,806,866; 2,809,998; 2,915,376; 2,915,528; 2,934,450; 2,937,098; 2,957,031; 3,472,894 and 3,555,089, Japanese Patent Publication Nos. 37304/70 and 9613/72, *J. Chem. Soc.*, 1950, 2739; ibid, 1957, 2574 and ibid, 1957, 2640: *J. Amer. Chem. Soc.*, 79, 2549 (1957); and *J. Japan Oil Chemist's Soc.*, 12, 653.

Some of the above organic fluoro-compounds are on commercially available under the trade names, for example, of Megafac F (e.g., F-110 ($C_8F_{17}SO_2K$), F-120 ($C_8F_{17}SO_2-\underset{\underset{C_3H_7}{|}}{N}-CH_2COOK$), F-144 ($C_8F_{17}SO_2\underset{\underset{C_3H_7}{|}}{N}CH_2CH_2O(CH_2CH_2O)_nH$ where n = 20), F-150 ($C_8F_{17}SO_2NH(CH_2)_3N^+CCH_3)_3I^-$), etc.) manufactured by Dai-Nippon Ink & Chemicals, Inc.; FC (e.g., FC-95, FC-128

$$(C_8F_{17}SO_2\underset{\underset{C_2H_4}{|}}{N}-CH_2COOK),$$

FC-134 ($C_8F_{17}SO_2NH(CH_2)_3N^+(CH_3)_3I^-$), FC-161, FC-170, FC-176, FC-430, FC-431, etc.) manufactured by Minnesota Mining Mfg. Co., Monflor (e.g., Monflor-31, -32, -51, -52, -53, -71, -91, etc.) manufactured by Imperial Chemical Ind. Ltd.; Zonyl S (e.g., S-13) manufactured by E. I. Dupont; and Licowet VPE manufactured by Farbwerke Hoechst A. G.

The carboxy group-containing compounds which can be employed in the present invention each contain at least one carboxy group and at least six carbon atoms in each molecule, and have a molecular weight not less than about 120, e.g., about 120 to 500.

Of these compounds, compounds having aliphatic hydrocarbon groups, e.g., having 1 to 21 carbon atoms, particularly alkyl groups, are useful. A behenyl group is particularly preferred.

In addition, these compounds contain alkyl groups which are not substituted with a fluorine atom or atoms.

The carboxy groups in these compounds can be in the form of a salt, for example, a metallic salt such as the sodium or potassium salt, a tertiary ammonium salt such as a trimethyl ammonium salt, a betaine structure and the like.

These carboxy-group containing compounds can be used individually or in combination, if desired.

From a practical point of view, compounds containing as a water soluble group only a carboxy group (e.g., anionic surface active agents containing carboxy groups as water soluble groups) and betaine type compounds which contain only carboxy groups as water soluble anionic groups are preferred.

Typical carboxy group-containing compounds which can be used in the present invention are represented by the following general formulae (6) to (10):

$$RCO-\underset{\underset{R'}{|}}{N}-A-COOM \qquad (6)$$

wherein

R represents an alkyl group (both unsubstituted and substituted) having 1 to 32 carbon atoms (e.g., a propyl group, an octyl group, etc.);

R' represents a hydrogen atom or an alkyl group (both unsubstituted and substituted) having 1 to 32 carbon atoms (e.g., a butyl group, a nonyl group, etc.);

A represents a divalent aliphatic hydrocarbon group, preferably a methylene group, an ethylene group, a propylene group, an ethylidene group or the like, and M represents a hydrogen atom, an alkali metal atom or an ammonium group, dissociating into an ion in an aqueous solution

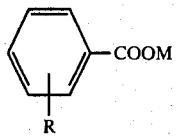
(7)

wherein R and M each is the same as described for formula (6)

RCOOM (8)

wherein R and M each is the same as described for formula (6)

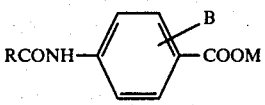
(9)

wherein R and M each is the same as described for formula (6), and B represents a hydroxy group, an alkoxy group having 1 to 4 carbon atoms (e.g., an ethoxy group, etc.), a carboxy group, an alkoxycarbonyl group (e.g., having 2 to 6 carbon atoms), an alkyl group (e.g., both unsubstituted and substituted, and having 1 to 6 carbon atoms) or the like

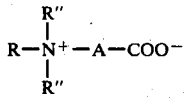
(10)

wherein R and A each is the same as described for formula (6) R″ represents a lower alkyl group (both unsubstituted and substituted) having 1 to 4 carbon atoms (e.g., a propyl group, etc.).

It is particularly advantageous that the surface of a light-sensitive material which comprises a protecting layer and/or emulsion layers containing both an organic fluoro-compound used in the present invention and at least one carboxy group-containing compound represented by the above-described general formulae (6) to (9) is impregnated with a compound having the general formula (10) through a dip-coating method, a spray-coating method or the like.

Specific examples of carboxy group-containing compounds used in the present invention are illustrated below.

$C_{11}H_{23}CON(CH_3)CH_2COONa$ (2-1)

$C_{11}H_{23}CON(CH_3)CH_2CH_2COONa$ (2-2)

$C_{14}H_{29}CON(CH_3)CH_2CH_2COONa$ (2-3)

$C_{15}H_{31}CON(C_3H_7)CH_2CH_2COONa$ (2-4)

$C_{17}H_{33}COONa$ (2-5)

-continued $C_{11}H_{23}COONa$ (2-6)

$C_{14}H_{29}N^+(CH_3)_2CH_2COO^-$ (2-7)

$C_{12}H_{25}N^+(CH_3)_2CH\ COO^-$ (2-8)

(2-9)

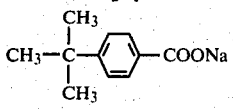
(2-10)

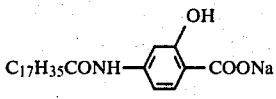
(2-11)

The organic fluoro-compounds employed in the present invention start to exhibit an improvement in the adhesion resistance of a surface layer when used in an amount of about 1 mg per 1 $m^2$ of the surface layer of a photographic material. The upper limit of the amount of the organic fluoro-compound employed is not critical but of course the fluoro-compound is not employed in an excess from the standpoint of effectiveness, economics, influences upon the human body and the like. The organic fluoro-compound preferably is used in an amount of 2 mg to 200 mg per 1 $m^2$ of the surface layer. On the other hand, the amount of the carboxy group-containing compound employed depends mainly upon the amount of the organic fluoro-compound employed therewith. In general, a useful amount of the carboxy group-containing compound employed is about 0.3 to 30 times, by weight, the amount of the organic fluoro-compound. More specifically, an amount of 0.5 to 25 times, by weight, the amount of the organic fluoro-compound is preferred.

The organic fluoro-compounds and the carboxy group-containing compounds used in the present invention can be employed in photographic light-sensitive materials in a conventional manner. For example, these compounds can be added to a coating solution employed for a surface layer directly or in the form of a solution dissolved in an appropriate solvent. The coating solution can be coated on a surface layer using conventional methods, for example, a dip method as disclosed in U.S. Pat. No. 3,335,026; an extrusion method as disclosed in U.S. Pat. No. 2,761,791; or a spray method as disclosed in U.S. Pat. No. 2,674,167. On the other hand, a method wherein these compounds in a liquid form are allowed to penetrate into a surface layer can also be employed herein. In this case, one of the above-described coating methods can be utilized selectively depending on the coating conditions. When the organic fluoro-compounds and/or carboxy group-containing compounds employed in the present invention are liquid, they can be used as they are or they can be diluted with appropriate solvents. When they are solid, they are employed in the form of solutions dissolved in appropriate solvents. Suitable solvents include water, lower alcohols (e.g., methanol, ethanol, isopropanol, etc.), acetone, ethylene glycol monomethylether, dimethylformamide and the like. These solvents can be employed individually or in combination, if desired.

When a solution containing the organic fluoro-compound and/or the carboxy group-containing compound is coated on a hydrophilic layer, the hydrophilic layer can be in a dried condition or in a moist condition (for example, including a condition wherein the hydrophilic layer after coating is coolset).

Drying after coating can be carried out in a conventional manner. For example, the coated layer can be dried with air of a controlled temperature and humidity, with microwaves, under reduced pressure and by similar means. An appropriate combination of these drying techniques can also be employed.

The organic fluoro-compounds and the carboxy group-containing compounds which are used in the present invention can be coated on hydrophilic layers which comprise all kinds of photographic materials. Such hydrophilic layers include a silver halide emulsion layer, a protecting layer, an intermediate layer, a filter layer, an anti-halation layer, a back layer, an image-receiving layer for the diffusion transfer process and the like. When the surface layer of a photographic material is one of the above-described hydrophilic layers, the presence of the organic fluoro-compounds and the carboxy group-containing compounds of the present invention in this surface layer improves the adhesion resistance and the anti-static properties thereof. Remarkable advantages can be obtained by coating the compounds of the present invention not only on the surface layer of a finished photographic light-sensitive material but also on a temporary surface layer of an intermediate product which is prepared in the manufacture of a photographic material. Since such intermediate products are often wound as a roll and stored in a roll form, considerable stress which is generated between the surface of a rolled intermediate product and the support thereof or the back layer thereof particularly tends to cause adhesion difficulties and the production of static marks.

The surface layer of the present invention contains hydrophilic colloids as a binder. All compounds which are usually employed in hydrophilic layers of photographic materials can be employed as these hydrophilic colloids. Suitable examples of such hydrophilic colloids are gelatin; colloidal albumin; casein; cellulose derivatives such as carboxymethyl cellulose, hydroxyethyl cellulose, etc.; saccharide derivatives such as agar, sodium alginate, starch derivatives, etc.; and synthetic hydrophilic colloids such as polyvinyl alcohol, polyvinyl pyrrolidone, acrylic copolymers, polyacrylamide, polyacrylamide derivatives; etc. A mixture of two or more kinds of colloids which are compatible with each other can be employed herein if desired. Of the above-described colloids, gelatin is quite commonly used, and the substitution of some portion of the gelatin with synthetic polymer compounds can also be advantageous. Moreover, the so-called gelatin derivatives, that is, the reaction products of the functional groups in the gelatin molecule such as amino, imino, hydroxy and carboxy groups, with the compounds containing at least one functional group which is reactive to one of the above functional groups of gelatin, and grafted compounds which are obtained by reacting gelatin with the molecular chains of other polymer compounds are also useful.

Compounds containing at least one functional group reactive with one of the above described functional groups of gelatin include, for example, the isocyanates, acid chlorides and acid anhydrides as disclosed in U.S. Pat. No. 2,614,928; the acid anhydrides as disclosed in U.S. Pat. No. 3,118,766; bromoacetates as disclosed in Japanese Patent Publication No. 5514/64; the phenylglycydyl ethers as disclosed in Japanese Patent Publication No. 26845/67; the vinylsulfones as disclosed in U.S. Pat. No. 3,132,945; the N-allylvinyl sulfonamides as disclosed in British Pat. No. 861,414; the maleinimides as disclosed in U.S. Pat. No. 3,186,846; the acrylonitriles as disclosed in U.S. Pat. No. 2,594,293; the polyalkylene oxides as disclosed in U.S. Pat. No. 3,312,553; the expoxides as disclosed in Japanese Patent Publication No. 26845/67; the acid esters as disclosed in U.S. Pat. No. 2,763,639 and the alkane sultones as disclosed in British Pat. No. 1,033,189.

The polymer compounds which can be graft-polymerized with gelatin are described in, for example, U.S. Pat. Nos. 2,763,625; 2,831,767; 2,956,884 and 3,620,751: *Polymer Letters,* 5, 595 (1967): Phot. Sci. Eng., 9, 148 (1965) and J. Polymer Sci., A-1, 9, 3199 (1971). A wide variety of vinyl polymers or copolymers containing vinyl monomers such as acrylic acid, methacrylic acid, an acrylic acid ester, an acrylamide, an acrylonitrile, a methacrylic acid ester, a methacrylamide, methacrylonitrile and styrene can be preferably employed as such polymer compounds. Of the above vinyl polymers, hydrophilic vinyl polymers which are compatible with gelatin, for example, homopolymers or copolymers of acrylic acid, methacrylic acid, acrylamide, methacrylamide, hydroxyalkyl acrylates or/and hydroxyalkylmethacrylates are more effective for use.

It is advantageous for the binder in the surface layer of a photographic material to be hardened in order to avoid excess swelling, scratching and peeling-off which happens in photographic processing. Commonly used well-known hardeners can be employed for the above-described purpose. Examples of such hardeners include chrome alum, aldehyde compounds, N-methylol compounds, ketone compounds, carboxylic acid derivatives, sulfonic acid esters and halogenated sulfonyl compounds, active halogen compounds, epoxides, aziridines, active olefin-containing compounds, isocyanates, carbodiimides and compounds containing in the same molecule two or more of these functional groups of the above hardeners, which are described in, for example, C. E. Mees & T. H. James *The Theory of the Photographic Process* Third Edition, page 54–60, Macmillan, New York (1966): U.S. Pat. Nos. 2,586,168; 2,725,294; 2,725,295; 2,732,303; 2,732,316; 2,983,611; 3,017,280; 3,091,537; 3,100,704; 3,103,437; 3,232,763; 3,232,764; 3,288,775; 3,316,095; 3,321,313; 3,490,911; 3,543,292; 3,635,718 and 3,642,486, and British Patent Nos. 974,723; 994,869; 1,167,027, etc. A suitable amount of hardener can range from about 0.1 to 10% by weight, preferably 0.5 to 5% by weight, based on the hydrophilic colloid.

The surface layer can contain surface active agents to facilitate the coating thereof. All of the commonly used coating assistants as used in manufacturing photographic materials can be advantageously employed as such surface active agents. Such coating assistants include acidic group-containing anionic surface active agents having carboxylic acid groups, sulfonic acid groups, phosphoric acid groups, sulfuric acid ester groups, phosphoric acid ester groups, etc.; amphoteric surface active agents of the carboxylic acid type, the sulfonic acid type, the sulfuric acid ester type, the phosphoric acid ester type, etc.; cationic surface active agents; nonionic surface active agents of the polyalkylene oxide series, the polyglycerin series, etc.; and natural surface active agents such as saponin. In addition, surface active agents have the action of allowing photographic processing solutions to uniformly wet the surface of a photographic material. Further, certain surface active agents exhibit an antistatic effect.

The surface layer can optionally contain additives in general employed in the surface layer of conventional photographic materials, for example, a slipping agent such as liquid paraffin, a polysiloxane, etc.; materials capable of selectively absorbing light such as ultraviolet light-absorbing agents and dyes; matting agents which are added to the surface layer within a concentration range wherein they hardly affect the transparency thereof, etc.

The surface layer prepared in the present invention can employed in all kinds of black-and-white and color photographic light-sensitive materials. The elements which form a silver halide photographic light-sensitive material, that is, a support, silver halide emulsion layers and if desired, light-insensitive auxiliary layers (e.g., a protecting layer, a filter layer, an intermediate layer, an antihalation layer, a back layer and so on) include those which are well-known to one skilled in the art.

Preferred supports employed in the present invention include a cellulose ester film such as a cellulose nitrate film, a cellulose acetate film, etc.; a polyester film such as a polyethylene terephthalate film; a polycarbonate film; a polyvinyl acetal film, a polyvinyl chloride film; a polystyrene film; baryta paper; a polyethylene-coated film and the like.

Preferred silver halide emulsions used in the present invention include any emulsions in which silver halide particles are dispersed in a polymer binder. Silver halides which are preferably used herein include silver bromide, silver iodobromide, silver chloroiodobromide, silver chlorobromide, silver chloride and the like. Preferred hydrophilic polymer binders used herein include gelatin and the above-described hydrophilic colloids. The silver halide emulsion can contain so-called transfer halide silver halide particles as disclosed in U.S. Pat. No. 3,622,318; British Pat. No. 635,841 and so on. The halide composition and the grain size of the silver halides are not particularly limited.

The silver halide emulsions used in the present invention can be sensitized using the sensitizers contained in gelatin as disclosed in U.S. Pat. Nos. 1,574,944; 1,623,499; 2,410,689; etc., or using sulfur compounds. The emulsions can also be sensitized using noble metal salts such as the salts of palladium, gold, etc., as disclosed in U.S. Pat. Nos. 2,448,060; 2,399,083; 2,642,361; etc. In addition, the emulsions can be sensitized using reducing agents such as stannous salts as disclosed in U.S. Pat. No. 2,487,850 and so on. Further, the emulsions can be sensitized with a polyalkylene oxide derivative. Moreover, the silver halide emulsions used in this invention can be spectrally sensitized with cyanine or merocyanine dyes as disclosed in U.S. Pat. Nos. 2,519,001; 2,666,761; 2,734,900; 2,739,964; 3,481,742 and so on.

The silver halide emulsions employed in the present invention can contain antifogging agents such as mercury compounds, azaindenes, etc., and stabilizing agents, and can also contain plasticizers such as glycerin, etc., and the above-described auxiliary coating agents. Moreover, the emulsions can contain antistatic agents, ultraviolet light-absorbing agents, fluorescence-increasing agents, antioxidizing agents, dyes and the like.

In addition, the silver halide emulsions employed in the present invention can contain 2 or 4 equivalent color couplers. Preferred color couplers which can be used herein are open-chain type ketomethylene yellow couplers such as the benzoylacetanilides and pivaloylacetanilides, pyrazolone or indazolone magenta couplers and phenolic or naphtholic cyan couplers.

The silver halide emulsions used in the present invention include various kinds of silver halide photographic emulsions such as ortho-type emulsions, panchromatic emulsions, emulsions for infrared photography, emulsions for X-ray photography, emulsions for other invisible ray photography, emulsions for color photography such as color coupler-containing emulsions, dye developer-containing emulsions, emulsions containing bleachable dyes, etc.

The photographic light-sensitive materials prepared in the present invention can contain light-insensitive auxiliary layers such as a protecting layer, a filter layer, an intermediate layer, an antihalation layer, a backing layer, etc. These auxiliary layers can contain hydrophilic polymer binders and optionally can contain dyes, antioxidizing agents, surface-active agents and other additives.

The photographic light-sensitive materials prepared in the present invention can contain in the constituent elements thereof hygroscopic or adhesive compounds. Such hygroscopic or adhesive compounds are often employed in photographic light-sensitive materials. Specific examples of hygroscopic or adhesive additives, which are employed to plasticize the photographic light-sensitive materials, are the glycols as disclosed in U.S. Pat. No. 2,960,404; the triols as disclosed in U.S. Pat. No. 3,042,524 and hydroxy groups-containing compounds such as cyclohexanediol, cyclohexane dimethanol, etc., as disclosed in U.S. Pat. No. 3,640,721. Other specific examples of such hygroscopic or adhesive additives, which are employed for preparing homogeneous dried-surfaces in the producing photographic light-sensitive materials, are trimethylol alkanes as disclosed in U.S. Pat. No. 3,520,694; polyglycydols as disclosed in U.S. Pat. No. 3,656,956; and the like. Still other specific examples of such hygroscopic and adhesive additives, which are employed for improving the photographic characteristics, are the 1,2-glycols as disclosed in U.S. Pat. No. 3,650,759; alicyclic compounds containing two or more hydroxy groups as disclosed in U.S. Pat. No. 3,619,198; heterocyclic compounds containing two or more hydroxy groups as disclosed in German patent application OLS No. 2,241,400; and so on. Other specific examples of such hygroscopic and adhesive additives, which are employed for incorporation of hydrophobic photographic additives into photographic layers, are organic solvents having high boiling points such as dibutyl phthalate, tricresyl phosphate, etc., as disclosed in U.S. Pat. No. 2,322,027.

Photographic materials containing these compounds in the surface layers thereof exhibit a much stronger hygroscopicity or adhesiveness, and easily lead to adhesion difficulties. The presence of such compounds in the surface layers of photographic materials is attributed to not only the coating of solutions containing such compounds as surface layers but also diffusion of such compounds into the surface layers from adjacent layers thereto incorporating such compounds. The combined use of the organic fluoro-compounds and the carboxy group-containing compounds in accordance with the present invention enables an improvement in adhesion resistance and anti-static properties of the surface layer even when photographic light-sensitive materials contain such hygroscopic or adhesive compounds.

It was quite unexpected that a deterioration in anti-static characteristics which occurs in the independent use of organic fluoro-compounds can be prevented by the combined use of the organic fluoro-compounds and the carboxy group-containing compounds in accordance with the present invention. When the compounds containing sulfo groups or phosphoric acid groups which are acid groups similar to a carboxy group are used together with the organic fluoro-compounds, delerioration of the anti-static properties of the surface layer containing organic fluoro-compounds can not be prevented, or a loss of the increased adhesion resistance resulting from the application of the organic fluoro-compounds occurs. The improvement in antistatic properties without a decrease in adhesion resistance is specific to the carboxy group-containing compounds and this fact is particularly surprising. The reason for the improvement in antistatic characteristics due to the combined use of the two kinds of compounds used in the present invention is still not completely theoretically understood, and, while not desiring to be bound, a mutual interaction relating to static characteristics, absorbing properties and so on between the two kinds of the compounds is suggested.

In accordance with the present invention, it has been found that photographic light-sensitive materials exhibit markedly increased adhesion resistance and antistatic properties. It has further been found that the present invention is free of disadvantages such as an aggregation of a coating solution, a reduction in transparency of the layers photographically processed and the like, which take place when conventional inorganic and organic matting agents are used.

The present invention will now be illustrated in greater detail by reference to the following examples. Unless otherwise indicated herein, all parts, percents, ratios and the like are by weight.

EXAMPLE 1

Six samples (1A) to (1F) each were prepared by coating onto a polyethylene terephthalate film support, successively, a silver halide emulsion layer having the composition as shown in Table 1 and a protective layer which had one of the six different compositions as shown in Table 1.

TABLE 1

| | Emulsion Layer | Protective Layer 1A | 1B | 1C | 1D | 1E | 1F |
|---|---|---|---|---|---|---|---|
| Binder | Gelatin (2.10 g/m$^2$) + Potassium Polystyrene-sulfonate (0.38 g/m$^2$) (mean molecular weight ; 100,000) | Gelatin (1.75 g/m$^2$) + Phthaloylated Gelatin (0.20 g/m$^2$) (phthaloylation degree: 95 mol%) | | | | | |
| Silver | (5.00 g/m$^2$(*)) | None | | | | | |
| Hardener | Sodium 2-Hydroxy-4,6-dichloro-s-triazine (0.5 g/100 g binder) | Sodium 2-Hydroxy-4,6-dichloro-s-triazine (0.4 g/100 g binder) | | | | | |
| Stabilizer | 1-Phenyl-5-mercapto-tetrazole (0.52 g/100 g binder) + 1,2-Cyclohexanediol (1.3 g/100 g binder) | None | | | | | |
| Surface Active Agent | None | None | None | Saponin (2g/100g binder) | Saponin (2g/100g binder) | Compound (1-14) (2g/100g binder) | Compound (1-14) (2g/100g binder) + Compound (2-4) (1g/100g binder) |
| Matting Agent | None | None | Silica Particles (Mean diameter 3μ) (1.5g/100g binder) | None | Silica | None Particles mean-dea-meter 3μ) (1.5g/100g binder) | None |

(*)Silver halide:Silver iodobromide containing 1.5 mol % of iodide

The evaluations relative to adhesion resistance, haze, quantity of static electricity generated by charging (hereinafter "charging amount") and static marks of each of the samples were carried out according to the methods described hereinafter.

(1) Adhesion Resistance

Two pieces of light-sensitive films each measuring 4×4 centimeters were cut from each of the samples. A protective layer of one piece was allowed to come into contact with a protective layer of another piece, to which 800 g of load was applied. The pieces were kept for one day at 40° C. and 90% RH. The samples were then separated, and the area adhered was measured. Adhesion resistance of each of the samples was evaluated according to the following criteria:

| Rank | Condition |
|---|---|
| A | 0 to 40% of area adhered |
| B | 41 to 60% of area adhered |
| C | 61 to 80% of area adhered |

-continued

| Rank | Condition |
|---|---|
| D | More than 80% of area adhered |

(2) Haze Measurement

Unexposed samples were developed, fixed, washed with water and dried. The haze values (%) of the processed samples were determined with an Integral Sphere Type Haze Meter—SEP—H—SS (manufactured by Nippon Seimitsu Kogaku Co., Ltd.). A smaller haze value suggests higher transparency.

(3) Measurement of the Charging Amount

Two pieces of each of the samples (measuring in 2×11 centimeters) were adhered with adhesive tape, adhesive on both surfaces, so that the surfaces to be measured were positioned towards the outside, and the assembly was kept for two hours at 25° C. and 30% RH for regulating the humidity. After passing the assembly between two rollers made of white rubber, the assembly was put in a Faraday cage. The charging amount (unit:-volt) was measured with an electrometer.

(4) Static Mark Test

Unexposed samples were closely adhered to fluorescent sensitizing paper for X-ray use using a rubber roller at 25° C. and 30% RH, and they, then, were separated. The resulting samples were developed for 30 sec. at 35° C. with a developing solution having the composition described hereinafter. The frequency of occurrence of static marks was examined, and evaluated according to the following criteria:

| Rank | Criteria |
|---|---|
| A | No static marks |
| B | Static marks occurred in not more than 50% of the area |
| C | Static marks occurred in 51 to 80% of the area |
| D | Static marks occured in 81% or more of the area |

-continued

| Developer Composition | |
|---|---|
| Sodium Sulfite | 40 g |
| Hydroquinone | 25 g |
| Boric Acid | 10 g |
| 1-Phenyl-3-pyrazolidone | 1.5 g |
| Potassium Hydroxide | 30 g |
| 5-Methylbenzotriazole | 0.15 g |
| Glutaraldehyde Bisulfite | 15 g |
| Acetic Acid | 12 g |
| Potassium Bromide | 5 g |
| Water to make | 1 liter |

The results obtained are summarized in Table 2 below.

TABLE 2

| | Sample | | | | | |
|---|---|---|---|---|---|---|
| | 1A | 1B | 1C | 1D | 1E | 1F |
| Adhesion Resistance | D | C | D | C | A | A |
| Haze Value | 12.9 | 43.0 | 13.1 | 44.6 | 23.2 | 21.7 |
| Charging Amount | +45 | +43 | +10 | +8 | −90 | −10 |
| Static Mark Occurrence | D | D | B | B | D | A |

Table 2 indicates that in the case of Sample (1E), containing Organic Fluoro-Compound (1-14) alone, the adhesion resistance was improved but a marked occurrence of static marks was observed. On the other hand, it was demonstrated that the combined use of Carboxy Group Containing Compound (2-4) and Compound (1-14) in Sample (1F) completely prevented static marks from occurring. In addition, it was found that no decrease in the transparency of the finished photographic materials was observed which was distinct from the situation with Sample (1B) and Sample (1D) containing conventional matting agents.

EXAMPLE 2

Eight samples (2A) to (2H) each were prepared by coating onto a polyethylene terephthalate film support successively, emulsion layer having the composition as shown in Table 3 and a protecting layer which had one of the eight different compositions as shown in Table 3.

TABLE 3

| | Emulsion Layer | Protecting Layer 2A | 2B | 2C | 2D | 2E | 2F | 2G | 2H |
|---|---|---|---|---|---|---|---|---|---|
| Binder | Gelatin (2.4g/m²) | Gelatin (1.75 g/m²) + Sodium Polystyrene Sulfonate (mean molecular weight ; 100,000) (0.20 g/m²) | | | | | | | |
| Silver | (5.00 g/m²(*)) | None | | | | | | | |
| Hardener | Sodium 2-Hydroxy-4,6-dichloro-s-triazine (0.5g/100g binder) | Sodium 2-Hydroxy-4,6-dichloro-s-triazine (0.4 g/100 g binder) | | | | | | | |
| Stabilizer | 1-Phenyl-5-mercaptotetrazole (0.52 g/100 g binder) + 1,2-Hexanediol (1.3g/100g binder) | None | | | | | | | |
| Surface Active Agent | None | None | Saponin (2g/100g binder) | Compound (1-11) (1g/100g binder) | Compound (2-1) (1g/100g binder) | Reference Compound A (1g/100g binder) | Compound (1-11) (1g/100g binder) + Compound (2-1) (1g/100g binder) | Compound (1-11) (1g/100g binder) + Reference Compound A (1g/100g binder) | Compound (1-11) (1g/100g binder) + Reference Compound A (10 g/100 g binder) |
| Matting Agent | None | Polymethylmethacrylate | None | None | None | None | None | None | None |

TABLE 3-continued

| Emulsion Layer | Protecting Layer 2A | 2B | 2C | 2D | 2E | 2F | 2G | 2H |
|---|---|---|---|---|---|---|---|---|
| | Particles (mean diameter of 3μ) (1.5 g/100g binder) | | | | | | | |

(*)Silver halide : Silver iodobromide containing 5 mol% of iodide
Reference Compound A : $C_{17}H_{33}CONCH_2SO_3Na$
|
$CH_3$ These samples were evaluated according to the methods as described in Example 1 with respect to adhesion resistance, charging amount and frequency of static mark-occurrence. The results obtained are shown in Table 4.

TABLE 4

| | Sample 2A | 2B | 2C | 2D | 2E | 2F | 2G | 2H |
|---|---|---|---|---|---|---|---|---|
| Adhesion Resistance | D | D | A | D | D | A | A | D |
| Charging Amount | +40 | +10 | −91 | +80 | +70 | −10 | −88 | −36 |
| Static Mark Occurrence | D | C | D | D | D | A | D | C |

The results in Table 4 indicate that Organic Fluoro-Containing Compound (1-11) improved the adhesion resistance, but it caused the occurrence of static marks. The occurrence of such static marks can be prevented by the combined use of the Carboxy Group-Containing Compound (2-1) and the above Fluoro-Containing Compound (1-11) in accordance with the present invention; when the Sulfo Group-Containing Compound A was used for reference instead of using the same amount of the Carboxy Group-Containing Compound (2-1), occurrence of static marks can hardly be prevented; and a much larger amount of the reference Sulfo Group-Containing Compound A can decrease the occurrence of static marks but it results in the deterioration of adhesion resistance. Namely, only the combination of the compounds employed in the present invention can effectively increase both the adhesion resistance and antistatic properties of the photographic light-sensitive materials.

EXAMPLE 3

The organic fluoro-compound and the carboxy group containing compound were allowed to penetrate into a photographic light-sensitive material, which was prepared by coating onto a cellulose triacetate film support successively, a silver halide emulsion and a protecting layer having the same composition as Sample (1A) in Example 1, in the form of solutions according to the methods which are summarized in Table 5.

The contents of each of these compounds were adjusted to be individually 7.8 mg/m$^2$ (corresponding to an addition of 0.4 g/100 g of the binder contained in the surface-protecting layer). These Samples (3A) to (3D) each were dried 25° C. (dry) and 20° C. (wet).

TABLE 5

| | Sample 3A | 3B | 3C | 3D |
|---|---|---|---|---|
| Solution I | Water-Methanol Solution (volume ratio; 2 : 1) of Compound (1-38) | | Water-Acetone Solution (volume ratio; 9 : 1) of Compound (1-42) | |
| Solution II | Water-Methanol Solution (volume ratio; 2 : 1) of Compound (2-5) | | Water-Acetone Solution (volume ratio; 9 : 1) of Compound (2-8) | |
| Coating Method | Mixture of Solutions I and II coated by a dipping method | Solution I coated by a dipping method and dried, followed by coating Solution II thereon by a dipping method | Mixture of Solutions I and II coated by a dipping method | Solution II coated by a dipping method and dried, followed by coating Solution I thereon by a dipping method |

Each of samples (3A) to (3D) and a control sample wherein the above solutions were not coated were evaluated with respect to adhesion resistance, charging amount and static mark occurrence according to the methods as described in Example 1. The results obtained are shown in Table 6.

TABLE 6

| | Sample 3A | 3B | 3C | 3D | Control |
|---|---|---|---|---|---|
| Adhesion Resistance | A | A | A | A | D |
| Charging Amount | −11 | −6 | −13 | −15 | +45 |
| Static Mark Occurrence | A | A | A | A | D |

From the results summarized in Table 6, it was found that sufficiently increased adhesion resistance and antistatic properties of photographic light-sensitive materials can also be obtained using a method wherein the organic fluoro-compound and the carboxy group-containing compound were allowed to penetrate into the surface layer.

EXAMPLE 4

Four Samples (4A) to (4D) each were prepared by coating onto a cellulose triacetate film support successively, an antihalation layer, a red-sensitive emulsion layer, an intermediate layer, a green-sensitive emulsion layer, a yellow filter layer, a blue-sensitive emulsion layer and one of the four different protecting layers whose compositions are shown in Table 7.

In each sample the antihalation layer was a gelatin layer, into which black colloidal silver (0.36 g/m$^2$) was dispersed, containing Hardener (1) and Coating Assistant (1); the red-sensitive emulsion layer contained a gelatin silver iodobromide emulsion (iodide content: 2.0 mol%), Sensitizing Dye (2), Stabilizing Agent (1), Hardener (2), Coating Assistant (1), Couplers (4) and (5) and Plasticizers (1) and (2); the intermediate layer was a gelatin layer containing Hardener (1), Coating Assistant (1) and Plasticizer (3); the green-sensitive emulsion layer contained a gelatin silver iodobromide emulsion (iodide content: 3.3 mol%) containing Sensitizing Dye (1), Stabilizing Agent (1), Hardener (2), Coating Assistant (1), Couplers (2) and (3), and Plasticizers (1) and (2); the yellow filter layer was a gelatin layer, into which yellow colloidal silver was dispersed, containing Hardener (1) and Coating Assistant (2); the blue-sensitive emulsion (iodide content: 3.3 mol%) contained Stabilizing Agent (1), Hardener (2), Coupler (1) and Plasticizers (1) and (2); and the protecting layer has the composition shown in Table 7.

TABLE 7

| | Sample | | | |
|---|---|---|---|---|
| | 4A | 4B | 4C | 4D |
| Binder | Gelatin (1.0 g/m$^2$) + Styrene-Maleic Acid Copolymer (viscosity infinity measured in 1% aqueous solution of sodium chloride : 0.40) (0.5 g/m$^2$) | | | |
| Hardener | Sodium 2-Hydroxy-4,6-dichloro-s-triazine (0.5 g/100 g binder) | | | |
| Surface Active Agent | Saponin (2 g/100 g binder) | Compound (1-19) (3 g/100 g binder) + Compound (2-7) (1.5 g/100 g binder) | | None |
| Matting Agent | Polymethylmethacrylate Particles (mean diameter of 2μ) (1.5 g/100 g binder) | None | Polymethylmethacrylate Particles (mean diameter of 2μ) (0.8 g/100 g binder) | None |

The additives employed for each layers were as follows:

Sensitizing Dye (1): pyridinium salt of anhydro-5,5'-diphenyl-9-ethyl-3,3'-di(2-sulfoethyl)oxacarbocyanine hydroxide Sensitizing Dye (2): pyridinium salt of anhydro-5,5'-dichloro-9-ethyl-3,3'-di(3-sulfoethyl)thiacarbocyanine hydroxide Stabilizing Agent (1): 4-hydroxy-6-methyl-1,3,3a,7-tetrazaindene Hardener (1): sodium salt of 2-hydroxy-4,6-dichloro-s-triazine Hardener (2): hexahydro-1,3,5-triacryloyl-s-triazine Surface Active Agent (1): sodium dodecylbenzene sulfonate Surface Active Agent (2): sodium salt of 2-sulfonato succinic acid bis(2-ethylhexyl)ester Plasticizer (1): di-n-butylphthalate Plasticizer (2): tri-N-(2-hydroxyethyl)-cyanuric acid Plasticizer (3): tricresyl phosphate Coupler (1): 2'-chloro-5'-2-(2,4-di-tert-amylphenoxy)-butylamido-α-(5,5-dimethyl-2,4-dioxo-3-imidazolidinyl)-α-(4-methoxybenzoyl)acetoanilide Coupler (2): 1-(2,4,6-trichlorophenyl)-3-{3-[(2,4-di-tert-amylphenoxy)acetamido]benzamido}-4-(4-methoxyphenyl)-azo-5-pyrazolone Coupler (3): 1-(2,4,6-trichlorophenyl)-3-{3-[(2,4-di-tert-amylphenoxy)acetamido]benzamido}-5-pyrazolone Coupler (4): 1-hydroxy-4-(2-acetylphenyl)azo-N-[4-(2,4-di-tert-amylphenoxy)butyl]-2-naphthamide Coupler (5): 1-hydroxy-N-dodecyl-2-naphthamide Each of Samples (4A) to (4D) were evaluated with respect to adhesion resistance, charging amount and static mark occurrence according to the methods described in Example 1.

The results obtained are shown in Table 8.

TABLE 8

| | Sample | | | |
|---|---|---|---|---|
| | 4A | 4B | 4C | 4D |
| Adhesion Resistance | C | A | A | D |
| Charging Amount | +12 | −13 | −11 | +40 |
| Static Mark Occurrence | B | A | A | D |

It can be seen from the results in Table 8 that color photographic light-sensitive materials having good adhesion resistance and antistatic properties can be obtained by the combined use of the organic fluoro-compound and the carboxy group-containing compound in accordance with the present invention. In addition, conventional matting agents can be simultaneously added thereto.

EXAMPLE 5

Samples (5A) to (5D) each were prepared by coating onto a cellulose triacetate film support successively, an antihalation layer, a red-sensitive layer and an intermediate layer. The compositions of an antihalation layer and a red-sensitive emulsion layer were the same as those in Example 4, and the composition of the intermediate layer is shown in Table 9.

TABLE 9

| | Sample | | | |
|---|---|---|---|---|
| | 5A | 5B | 5C | 5D |
| Binder | Gelatin (1.5 g/m$^2$) | | | |
| Hardener | Sodium 2-Hydroxy-4,6-dichloro-s-triazine (0.5 g/100 g binder) | | | |
| Plasticizer | Dibutyl Phthalate (11 g/100 g binder) | | | |
| Surface Active Agent | Compound (1-34) (0.2 g/100 g binder) + Compound (2-2) (0.2 g/100 g binder) | Compound (1-34) (2 g/100 g binder) + Compound (2-2) (2 g/100 g binder) | Compound (1-34) (6 g/100 g binder) + Compound (2-2) (6 g/100 g binder) | Sodium Dodecyl Benzene Sulfonate (3 g/100 g binder) |

Two pieces of light-sensitive films each measuring 4×4 centimeters were cut from each of Samples (5A) to (5D), and were placed such that they did not contact each other. Subsequently, they were kept for regulating the humidity of the above films for two days at 35° C. and 90% RH without contacting with each other. The protecting layer of each of the samples was allowed to come into contact with the film support thereof, to which 1 kg of load was applied. The samples were kept for two days at 35° C. and 90% RH. The resulting layers in contact of each of the samples were separated, and the adhesion resistance thereof was evaluated as described in Example 1. Moreover, the measurement of charging amount and static mark occurrence were carried out according to the methods as described in Example 1. The results obtained are shown in Table 10.

TABLE 10

| | Sample | | | |
|---|---|---|---|---|
| | 5A | 5B | 5C | 5D |
| Adhesion Resistance | A | A | A | D |
| Charging Amount | −12 | −11 | −13 | +30 |
| Static Mark Occurrence | A | A | A | D |

It can be seen from the results in Table 10 that even a layer containing a plasticizer such as dibutyl phthalate was also remarkably improved in adhesion resistance and antistatic properties by the combined use of the organic fluoro-compound and the carboxy group-containing compound in accordance with the present invention.

EXAMPLE 6

Samples (6A) to (6E) each were prepared by coating onto a baryta paper successively, a silver halide emulsion layer having the composition as shown in Table 11 and a protective layer which had one of the five different compositions as shown in Table 11.

TABLE 11

| | Emulsion Layer | Protective Layer | | | | |
|---|---|---|---|---|---|---|
| | | 6A | 6B | 6C | 6D | 6E |
| Binder | Gelatin (6 g/m$^2$) | Gelatin (1 g/m$^2$) | | | | |
| Silver | 1.7 g/m$^2$(*) | None | | | | |
| Hardener | Mucochloric Acid (1 g/100 g binder) | Muchchloric Acid (0.5 g/100 g binder) + Dimethylol Urea (1 g/100 g binder) | | | | |
| Stabilizer | 1-Phenyl-5-mercapto-tetrazole (1g/100 g binder) | None | | | | |
| Plasticizer | Polyglycidol (14 g/100 g binder) | None | | | | |
| Surface Active Agent | Saponin (2 g/100 g binder) | Saponin (2g/100g (binder) | Compound (1-31) (0.29/100g binder) + Compound (2-10) (0.1g/100g binder) | Compound (1-31) (0.2g/100g binder) + Compound (2-10) (0.5g/100g binder) | Compound (1-31) (0.2g/100g binder) + Compound (2-10) (1g/100g binder) | Compound (1-31) (0.2g/100g binder) + Compound (2-10) (5g/100g binder) |
| Matting Agent | None | Magnesium Oxide Particles (mean diameter of 4μ) (1.5g/100g binder) | None | None | None | None |

(*)Silver Halide : Silver chlorobromide containing 50 mol% chloride

These samples were evaluated according to the methods as described in Example 1 with respect to adhesion resistance, charging amount and frequency of static mark-occurrence. The results obtained are shown in Table 12.

TABLE 12

| | Sample | | | | |
|---|---|---|---|---|---|
| | 6A | 6B | 6C | 6D | 6E |
| Adhesion Resistance | D | A | A | A | A |
| Charging Amount | +10 | −13 | −12 | −11 | −11 |
| Static Mark Occurrence | C | A | A | A | A |

It can be seen from the results in Table 12 that a photographic light-sensitive material having hydrophilic photographic layers containing a plasticizer such as a polyglycidol in contact with the surface layer thereof can have greatly increased adhesion resistance and antistatic properties when the organic fluoro-compound and the carboxy group-containing compound were applied to the surface layer in accordance with the present invention.

While the invention has been described in detail and with reference to specific embodiments thereof, it will be apparent to one skilled in the art that various changes and modifications can be made therein without departing from the spirit and scope thereof.

What is claimed is:

1. In a photographic light-sensitive material containing a support comprising thereon at least one light-sensitive silver halide emulsion layer and a protecting layer, the said material containing at least one hygroscopic or adhesive plasticizer compound selected from the group consisting of cyclohexanediol, cyclohexane dimethanol, dibutyl phthalate, tricresyl phosphate, 1,2-hexanediol, tri-N-(2-hydroxyethyl) cyanuric acid and polyglycidol in at least one of the said layers on the support, the improvement wherein in the said protecting layer contains and/or the said light-sensitive halide emulsion layer, in amounts in combination sufficient to improve adhesion resistance and antistatic properties (a) at least one organic fluoro-compound selected from group consisting of compounds having the general formula (1) to (3), (1) $W_1$-$Y_1$ wherein $W_1$ represents

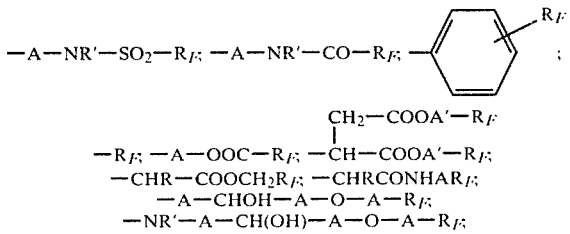

-continued

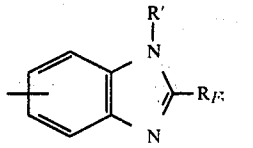

$-(CF_2-CFCl)_n-CF_2Cl$; $-(CFCl-CF_2)_nCOOM$;

$-A-CH=CH-R_F$; $-A-R_F$; 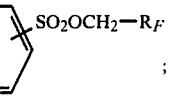 ; or $-A-\underset{\underset{MOOC}{|}}{CH}-A'-(CF_2)_n-O-R_F$ $MOOC-CH-A'-(CF_2)_n-O-R_F$; and $Y_1$ represents $-SO_3M$; $-OSO_3M$; $-COOM$; or $-PO_3M_2$;

(2) $W_2$-$Y_2$ wherein $W_2$ represents $-A-R_F$; $-O-A-CH(OH)-A-O-A-R_F$;

$-O-CH(-A-O-A-R_F)-A-O-A-CF_2CF_2H$;

$-O-A-R_F$; $-OOC-R_F$; 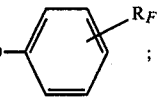 ;

$-O-A-NR'-CO-R_F$; $-O-A'NR-SO_2-R_F$; or $-(O-A)_n-OOC-R_F$ and $Y_2$ represents $-(CH_2CH_2O)_nH$ or $-(CH_2CH_2O)_nR'$;

(3) $W_3$-$Y_3$ wherein $W_3$ represents $NR_F-OOC-R_F$; $-A-R_F$ or

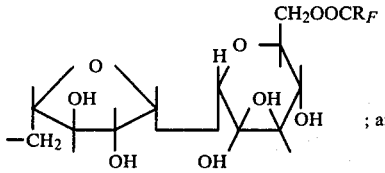

; and $Y_3$ represents $-OH$ or $-OOCR'$ in the above general formulae (1) to (3), R represents an alkyl group having 1 to 32 carbon atoms, R' represents a hydrogen atom or an alkyl group having 1 to 32 carbon atoms, A and A' each represents a divalent aliphatic hydrocarbon group, M represents a hydrogen atom or an alkali metal atom or an ammonium group dissociating into an ion in an aqueous solution, $R_F$ represents a perfluoroalkyl group having 1 to 22 carbon atoms, and n represents 0 or an integer ranging from 1 to 20; and (b) a carboxy group-containing compound of the general formula (6)

$$RCO-\underset{\underset{R'}{|}}{N}-A-COOM \quad (6)$$

wherein R represents an alkyl group having 1 to 32 carbon atoms; R' represents a hydrogen atom or an alkyl group having 1 to 32 carbon atoms; A represents a divalent aliphatic hydrocarbon group, and M represents a hydrogen atom, an alkali metal atom or an ammonium group, dissociating into an ion in an aqueous solution.

2. The material of claim 1, wherein said organic fluorocompound is a compound having the general formula (I) and said carboxy group-containing compound is a compound having the general formula (6).

3. The material of claim 1, wherein said at least one organic fluoro-compound is selected from the group consisting of $CF_3(CF_2)_6-COONH_4$, $CF_3(CF_2)_9-(CH_2)_{10}-COOH$, $CF_3(CF_2)_5-(CH_2)_{10}-COONa$, $ClCF_2-(\underset{\underset{Cl}{|}}{CF}-CF_2)_4-COOH$, $H(CF_2CF_2)_5-COONa$, $HOOC-(\underset{\underset{Cl}{|}}{CF_2-CF})_4-COOH$, $Cl(\underset{\underset{Cl}{|}}{CF_2-CF})_3-CF_2-COOK$ $CF_3-(CF_2)_6-CH=CH-(CH_2)_3-COONa$, $CF_3-(CF_2)_3-\underset{\underset{CF_3}{|}}{CF}-(CH_2)_{10}-COONa$, $H(CF_2CF_2)_4-CH_2OSO_2-$ 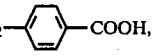 $-COOH$, $CF_3(CF_2)_7-CO-\underset{\underset{CH_3}{|}}{N}-(CH_2)_2-COONa$ $Cl(CF_2CF_2)_3-COONa$, $CF_3(CF_2)_3-CH_2CH_2-SO_2-\underset{\underset{C_2H_5}{|}}{N}-CH_2-COONa$, $CF_3(CF_2)_7-SO_2-\underset{\underset{C_2H_5}{|}}{N}-CH_2-COONa$, $CF_3(CF_2)_7-SO_2-\underset{\underset{C_2H_5}{|}}{N}-(CH_2)_6-COOK$, $CF_3(CF_2)_7-SO_2-\underset{\underset{C_3H_7}{|}}{N}-CH_2-COOK$, $CF_3(CF_2)_7-SO_2-\underset{\underset{C_3H_7}{|}}{N}-(CH_2)_3-COOK$, $CF_3(CF_2)_7-SO_2-\underset{\underset{C_2H_5}{|}}{N}-CH_2-SO_3H$, $CF_3(CF_2)_6-CO-\underset{\underset{C_2H_5}{|}}{N}-(CH_2)_2-SO_3K$, $CF_3(CF_2)_2-$ 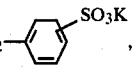 , $CF_3(CF_2)_3-$ 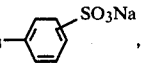 , $CF_3(CF_2)_7-SO_3K$, $CF_3(CF_2)_{11}-CH_2-OSO_3Na$, $CF_3(CF_2)_6-COO-(CH_2)_3-SO_3Na$, $H(CF_2)_6-CH_2-O-(CH_2)_3-SO_3Na$, $NaO_3S-\underset{\underset{CH_2-COOCH_2-(CF_2)_6-H}{|}}{CH}-COOCH_2-(CF_2)_6-H$, $C_{16}H_{33}-\underset{\underset{SO_3Na}{|}}{CH}-COOCH_2-CF_3$, $C_{16}H_{33}-\underset{\underset{SO_3Na}{|}}{CH}-CONHCH_2-CH_2-CF_2H$, $CF_3-(CF_2)_7-SO_2-\underset{\underset{CH_3}{|}}{N}-CH_2CH_2OSO_3H$, -continued

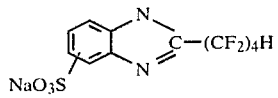

$C_8F_{17}SO_2N(C_2H_5)CH_2CH_2PO(OH)_2$, $C_8F_{17}SO_2N(C_3H_7)CH_2CH{=}PO(OH)_2$, $CF_3{-}(CF_2)_{12}{-}COO{-}(CH_2CH_2O)_{20}H$, $CF_3{-}(CF_2)_6{-}CO{-}N(CH_3){-}(CH_2)_2{-}O{-}(CH_2CH_2O)_4H$, $CF_3(CF_2)_7{-}SO_2{-}N(C_2H_5){-}(CH_2)_2{-}O{-}(CH_2CH_2O)_{20}H$, $CF_3{-}(CF_2)_8{-}COO{-}(CH_2CH_2O)_8{-}CH_3$, $H{-}(CF_2CF_2)_8{-}CH_2OH$, $H{-}(CF_2CF_2)_3{-}CH_2OH$, $CF_3{-}(CF_2)_6{-}COO(CH_2{-}CH(CH_3){-}O)_4{-}(CH_2CH_2O)_{20}H$, $CF_3(CF_2)_6{-}COO{-}(CH_2{-}CH(CH_3){-}O)_3{-}(CH_2CH_2O)_m{-}(CH_2)_4{-}CH_3$, $CF_3{-}C(C_2H_5)(C_2F_5){-}C(CF_3)(CH_2O(CH_2CH_2O)_7H){-}CHF{-}CF_3$, $CF_3{-}C(C_2H_5)(C_2F_5){-}C(CF_3)(COO(CH_2CH_2O)_4H){-}CHF{-}CF_3$, $CF_3{-}C(C_2H_5)(C_2F_5){-}C(CF_3)(COONa){-}CHF{-}CF_3$, $CF_3{-}C(C_2H_5)(C_2F_5){-}CH(CF_3){-}CF{-}COONa$, $CF_3{-}C(C_2H_5)(C_2F_5){-}C(CF_3)(SO_3Na){-}CHF{-}CF_3$, $CF_3{-}C(C_2H_5)(C_2F_5){-}CH(CF_3){-}CF{-}SO_3Na$,

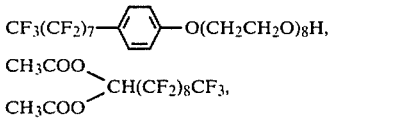

$CF_3(CF_2)_7{-}C_6H_4{-}O(CH_2CH_2O)_8H$,

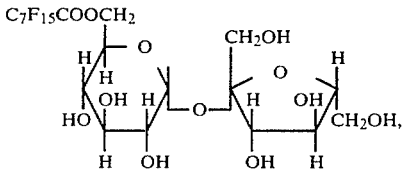

$(CH_3COO)_2CH(CF_2)_8CF_3$, $C_7F_{15}COOCH_2$

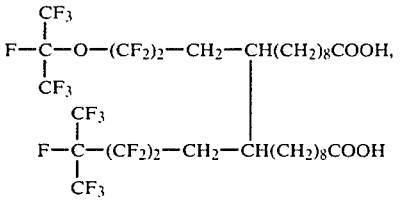

$F{-}C(CF_3)_2{-}O{-}(CF_2)_2{-}CH_2{-}CH(CH_2)_8COOH$, $F{-}C(CF_3)_2{-}(CF_2)_2{-}CH_2{-}CH(CH_2)_8COOH$

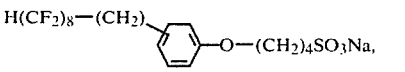

$H(CF_2)_8{-}(CH_2)C_6H_4{-}O{-}(CH_2)_4SO_3Na$,

-continued $H(CF_2)_6{-}CH_2{-}O{-}CH_2CH(OH)CH_2SO_3K$, $H(CF_2)_4{-}CH_2{-}O{-}CH_2CH(CH_3)CH_2{-}N{-}SO_3Na$, $H(CF_2)_8{-}CH_2{-}O{-}CH_2CH(OH)CH_2{-}N(CH_3){-}CH_2CH_2SO_3Na$, $H(CF_2)_4{-}CH_2{-}O{-}CH_2CH(OH)CH_2{-}O{-}(CH_2CH_2O)_4H$, $H(CF_2)_6{-}CH_2{-}O{-}CH_2CH(O{-}(CH_2CH_2O)_8H){-}CH_2{-}O{-}CH_2CF_2CF_2H$,

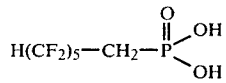

$H(CF_2)_5{-}CH_2{-}P(=O)(OH)_2$ and

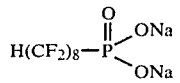

$H(CF_2)_8{-}P(=O)(ONa)_2$

4. The material of claim 1, wherein said at least one organic fluoro-compound is selected from the group consisting of $CF_3(CF_2)_7{-}CO{-}N(CH_3){-}(CH_2)_2{-}COONa$, $CF_3(CF_2)_7{-}SO_2{-}N(C_2H_5){-}CH_2{-}COONa$, $CF_3(CF_2)_6{-}CO{-}N(C_2H_5){-}(CH_2)_2{-}SO_3K$, $C_8F_{17}SO_2N(C_2H_5)CH_2CH_2PO(OH)_2$ $CF_3{-}(CF_2)_6{-}CO{-}N(CH_3){-}(CH_2)_2{-}O{-}(CH_2CH_2O)_4H$, and $H{-}(CF_2CF_2)_3{-}CH_2OH$

5. The material of claim 1, wherein said compound of the general formula (6) is $C_{11}H_{23}CON(CH_3)CH_2COONa$ $C_{11}H_{23}CON(CH_3)CH_2CH_2COONa$ $C_{14}H_{29}CON(CH_3)CH_2CH_2COONa$ $C_{15}H_{31}CON(C_3H_7)CH_2CH_2COONa$ or

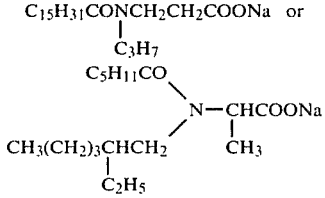

6. The material of claim 1, wherein said plastisizer compound is dibutyl phthalate, cyclohexanediol, cyclohexane dimethanol, 1,2-hexanediol, tri-N-(2-hydroxyethyl)cyanuric acid or polyglycidol.

7. In a method for improving the adhesion resistance and antistatic properties of a photographic light-sensitive material having a silver halide emulsion layer and containing a hygroscopic or adhesive plasticizer compound selected from the group consisting of cyclohexanediol, cyclohexane dimethanol, dibutyl phthalate, tricresyl phosphate, 1,2-hexanediol, tri-N-(2-hydroxyethyl) cyanuric acid and polyglycidol in a layer on a support, the improvement which comprises impregnating a protecting layer and/or an emulsion layer of the light-sensitive material containing at least one organic fluorocompound selected from group consisting of compounds having the general formula (1) to (3);

(1) $W_1$-$Y_1$ wherein $W_1$ represents

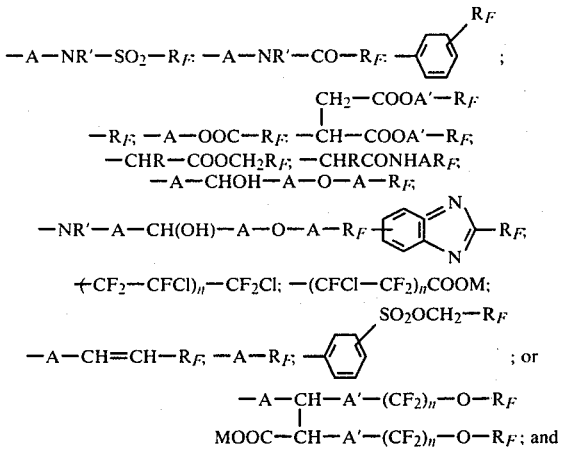

$Y_1$ represents $-SO_3M$; $-OSO_3M$; $-COOM$; or $-PO_2M_2$;

(2) $W_2$-$Y_2$ wherein $W_2$ represents

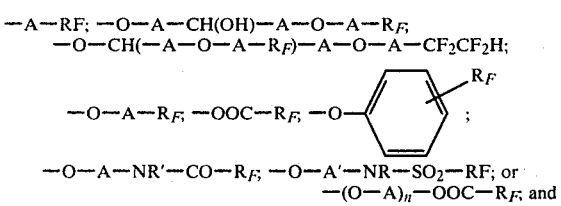

$Y_2$ represents $-(CH_2CH_2O)_nH$ or $-(CH_2CH_2O)_nR'$ (3) $W_3$-$Y_3$ wherein $W_3$ represents

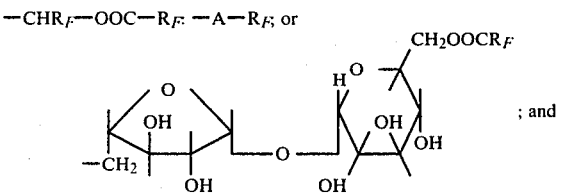

$Y_3$ represents —OH or —OOCR', wherein in the general formulae (1) to (3), R represents an alkyl group having 1 to 32 carbon atoms, R' represents a hydrogen atom or an alkyl group having 1 to 32 carbon atoms, A and A' each represents a divalent aliphatic hydrocarbon group, M represents a hydrogen atom or an alkali metal atom or an ammonium group dissociating into an ion in an aqueous solution; $R_F$ represents a perfluoroalkyl group having 1 to 22 carbon atoms; and n represents 0 or an integer ranging from 1 to 20; with an aqueous solution containing at least one carboxy group-containing compound of the general formula (6)

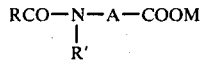

(6)

wherein R represents an alkyl group having 1 to 32 carbon atoms; R' represents a hydrogen atom or an alkyl group having 1 to 32 carbon atoms; A represents a divalent aliphatic hydrocarbon group, and M represents a hydrogen atom, an alkali metal atom or an ammonium group dissociating into an ion in aqueous solution.

8. The method of claim 7, wherein said organic fluorocompound is a compound having the general formula (1) and said carboxy group-containing compound is a compound having the general formula (6).

9. The method of claim 7, wherein said at least one organic fluoro-compound is selected from the group consisting of

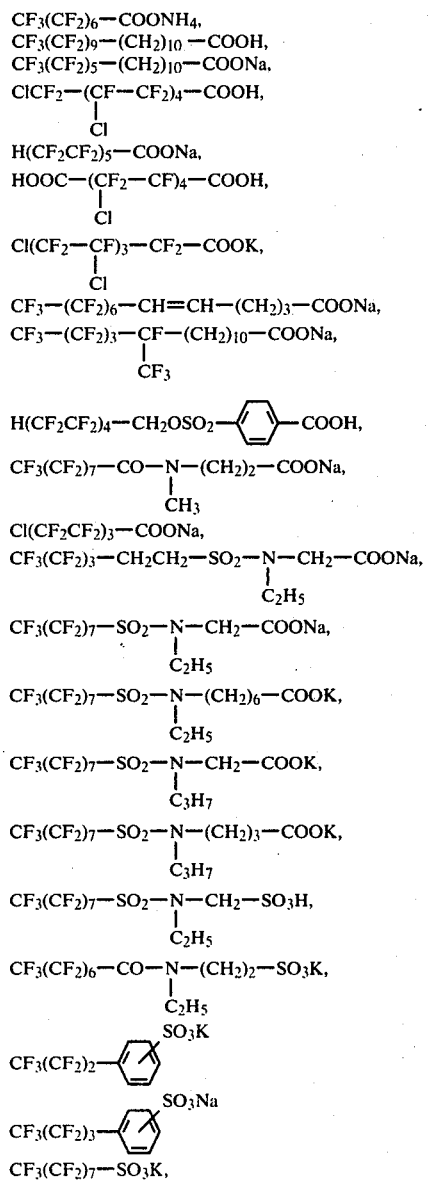

-continued $CF_3(CF_2)_{11}-CH_2-OSO_3Na$, $CF_3(CF_2)_6-COO-(CH_2)_3-SO_3Na$, $H(CF_2)_6-CH_2-O-(CH_2)_3-SO_3Na$, $NaO_3S-CH(CH_2-COOCH_2-(CF_2)_6-H)-COCCH_2-(CF_2)_6-H$ $C_{16}H_{33}-CH(SO_3Na)-COCCH_2-CF_3$, $C_{16}H_{33}-CH(SO_3Na)-CONHCH_2-CH_2-CF_2H$, $CF_3-(CF_2)_7-SO_2-N(CH_3)-CH_2CH_2OSO_3H$,

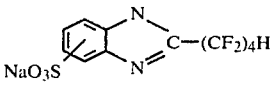

$C_8F_{17}SO_2N(C_2H_5)CH_2CH_2PO(OH)_2$, $C_8F_{17}SO_2N(C_3H_7)CH_2CH=PO(OH)_2$, $CF_3-(CF_2)_{12}-COO-(CH_2CH_2O)_{20}H$, $CF_3-(CF_2)_6-CO-N(CH_3)-(CH_2)_2-O-(CH_2CH_2O)_4H$, $CF_3(CF_2)_7-SO_2-N(C_2H_5)-(CH_2)_2-O-(CH_2CH_2O)_{20}H$, $CF_3-(CF_2)_8-COO-(CH_2CH_2O)_8-CH_3$, $H-(CF_2CF_2)_8-CH_2OH$, $H-(CF_2CF_2)_3-CH_2OH$, $CF_3-C(C_2F_5)_2-CH(CF_3)-CF(CF_3)-COONa$, $CF_3-C(C_2F_5)_2-C(SO_3Na)(CF_3)-CHF-CF_3$, $CF_3-C(C_2F_5)_2-CH(CF_3)-CF(CF_3)-SO_3Na$,

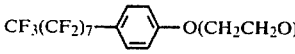

$CH_3COO-CH(CF_2)_8CF_3-CH_3COO$, $CF_3-(CF_2)_6-COO(CH_2-CH(CH_3)-O)_4-(CH_2CH_2O)_{20}H$, $CF_3(CF_2)_6-COO-(CH_2-CH(CH_3)-O)_x-(CH_2CH_2O)_m-(CH_2)_4-CH_3$, $CF_3-C(C_2F_5)_2-C(CH_2O(CH_2CH_2O)_7H)(CF_3)-CHF-CF_3$, $CF_3-C(C_2F_5)_2-C(COO(CH_2CH_2O)_4H)(CF_3)-CHF-CF_3$, $CF_3-C(C_2F_5)_2-C(COONa)(CF_3)-CHF-CF_3$,

-continued

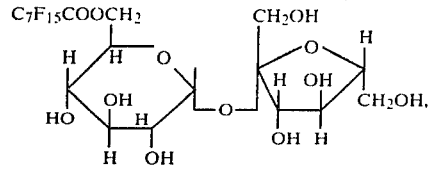

$F-C(CF_3)_2-O-(CF_2)_2-CH_2-CH(CH_2)_8COOH$, $F-C(CF_3)_2-(CF_2)_2-CH_2-CH(CH_2)_8COOH$

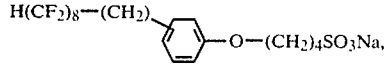

$H(CF_2)_8-(CH_2)-C_6H_4-O-(CH_2)_4SO_3Na$, $H(CF_2)_6-CH_2-O-CH_2CH(OH)CH_2SO_3K$, $H(CF_2)_4-CH_2-O-CH_2CH(OH)CH_2-N(CH_3)-SO_3Na$, $H(CF_2)_8-CH_2-O-CH_2CH(OH)CH_2-N(CH_3)-CH_2CH_2SO_3Na$, $H(CF_2)_4-CH_2-O-CH_2CH(OH)CH_2-O-(CH_2CH_2O)_4H$, $H(CF_2)_6-CH_2-O-CH_2CH(O-(CH_2CH_2O)_8H)-CH_2-O-CH_2CF_2CF_2H$, $H(CF_2)_5-CH_2-P(=O)(OH)(OH)$ and $H(CF_2)_8-P(=O)(ONa)(ONa)$.

10. The method of claim 7 wherein said at least one organic fluorocompound is selected from the group consisting of $CF_3(CF_2)_7-CO-N(CH_3)-(CH_2)_2-COONa$, $CF_3(CF_2)_7-SO_2-N(C_2H_5)-CH_2-COONa$, $CF_3(CF_2)_6-CO-N(C_2H_5)-(CH_2)_2-SO_3K$, $C_8F_{17}SO_2N(C_2H_5)CH_2CH_2PO(OH)_2$, $CF_3-(CF_2)_6-CO-N(CH_3)-(CH_2)_2-O-(CH_2CH_2O)_4H$, and $H-(CF_2CF_2)_3-CH_2OH$

11. The method of claim 7, wherein said compound of the general formula (6) is $C_{11}H_{23}CON(CH_3)CH_2COONa$ $C_{11}H_{23}CON(CH_3)CH_2CH_2COONa$ -continued

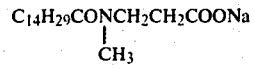

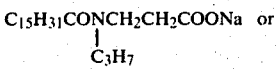

-continued

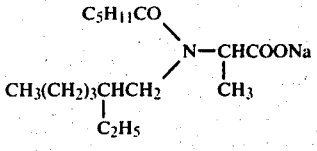

12. The method of claim 7, wherein said plastisizer compound is dibutyl phthalate cyclohexanediol, cyclohexane dimethanol, 1,2-hexanediol, tri-N-(2-hydroxyethyl)cyanuric acid or polyglycidol.

13. The method of claim 7, wherein said aqueous solution includes methyl alcohol, ethyl alcohol, n-propyl alcohol, isopropyl alcohol, acetone or methyl ethyl ketone.

* * * * *